US005993240A

United States Patent [19]

Schaefer

[11] Patent Number: 5,993,240

[45] Date of Patent: Nov. 30, 1999

[54] RETENTION AND STRAIN RELIEF APPARATUS FOR CONNECTING TWO DEVICES

[75] Inventor: Henry A. Schaefer, Lynchburg, Va.

[73] Assignee: Ericsson Inc., Research Triangle Park, N.C.

[21] Appl. No.: 08/902,411

[22] Filed: Jul. 29, 1997

[51] Int. Cl.[6] ..... H01R 13/627

[52] U.S. Cl. ..... 439/359; 439/352; 439/353; 439/953

[58] Field of Search ..... 439/350–359, 439/953

[56] References Cited

U.S. PATENT DOCUMENTS 4,120,553 10/1978 Muz ..... 439/352
5,158,473 10/1992 Takahashi et al. ..... 439/353
5,197,895 3/1993 Stupecky ..... 439/352
5,316,495 5/1994 Frantz ..... 439/350
5,702,266 12/1997 Jones ..... 439/352

*Primary Examiner*—Hien Vu
*Attorney, Agent, or Firm*—Jenkens & Gilchrist, P.C.

[57] ABSTRACT

A connector for securing components is disclosed. A hooked portion extending axially from a first device engages a cavity portion within a second, receiving device. A fastener within the first device is secured to said hooked portion in a transverse direction, and through transverse tightening secures the first and second devices together.

8 Claims, 3 Drawing Sheets

RETENTION AND STRAIN RELIEF APPARATUS FOR CONNECTING TWO DEVICES

BACKGROUND OF THE PRESENT INVENTION

1. Field of the Present Invention

The present invention is directed to the art of component interconnection, particularly, to a connector and fastener for securing one electronic component to another.

2. Background and Objects of the Present Invention

With the rapid proliferation of computers, telecommunications and other electronic components in our society, and with the great variety of peripheral devices interconnected thereto, interface protocols have developed to standardize the physical interconnection of one electronic component to another. One such standard is the Universal Devices Connector (UDC) standard which is currently employed to govern the interconnection of various electronic components, e.g., a mouse or printer to a computer or a microphone to a private radio system such as in a police or emergency vehicle.

An inherent problem in utilizing combinations of interconnected components, particularly in heavy usage applications, e.g., a portable computer, is increasing stress placed upon the points of interconnection. For example, in the use of desktop computers, any peripheral attached thereto, e.g., a monitor or printer, must be securely affixed to a port at the computer side and a port at the peripheral side. Secure attachment is, of course, necessary to maintain the requisite electronic communication connection. With portable equipment, e.g., emergency or police radio systems, however, additional stresses and strains act on the attachment areas. It should, therefore, be understood that as electronic equipment becomes even more powerful and portable, the need for secure component connections under diverse conditions will become more important.

Although conventional connection devices suffice in a passive connection environment, e.g., the aforementioned desktop computer with all peripheral connections shielded from external stress sources behind a desk, there is clearly a need for an improved electronic connection device that provides mechanical integrity under a more active or rugged environment where greater stresses are placed at the interconnection points.

It is, accordingly, a first object of the present invention to provide the aforementioned improvement in mechanical integrity to the connection interface of two components.

It is another object of the present invention to provide an improved connection mechanism facilitating component installation and removal.

SUMMARY OF THE INVENTION

The present invention is directed to a connector for securing components together. A hooked portion extending axially from a first device engages a cavity portion within a second, receiving device. A fastener within the first device is secured to said hooked portion in a transverse direction, and through transverse tightening secures the first and second devices together.

A more complete appreciation of the present invention and the scope thereof can be obtained from the accompanying drawings which are briefly summarized below, the following detailed description of the presently-preferred embodiments of the invention, and the appended claims.

DETAILED DESCRIPTION OF THE PRESENT PREFERRED EXEMPLARY EMBODIMENTS

The present invention will now be described more fully hereinafter with reference to the accompanying drawings in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figures 1, 2:
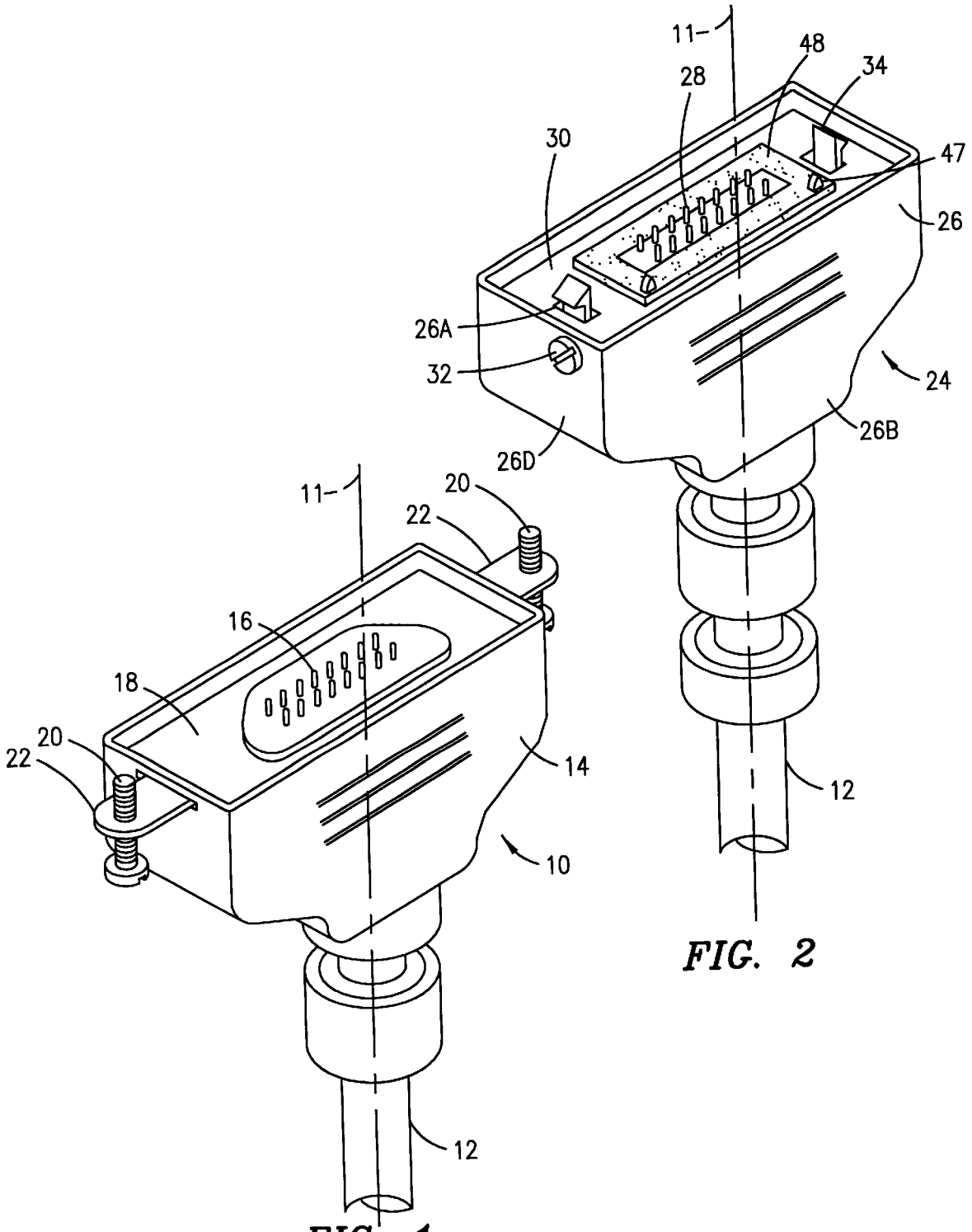
FIG. 1 (PRIOR ART)
FIG. 1 is a perspective view of a conventional connector apparatus.
FIG. 2 is a perspective view of a first embodiment of a connector apparatus in accordance with the present invention.

With reference now to FIG. 1 of the drawings there is illustrated a conventional retaining connector, generally referred to by the reference numeral 10, such as may be found at the end of a cable 12 attaching a computer monitor to a computer (not shown). The retaining connector 10 includes a connector body 14 attached at one end to said cable 12 and preferably leading to a similar connector 10 at the other end thereof. Also shown in FIG. 1 are a multiplicity of contact pins 16 forming a particular pattern within an interface portion 18 of connector body 14. When the pattern of contact pins 16 are inserted into a corresponding receptor portion of a receiving device (not shown), the pins 16 make electrical connection to that device, e.g., a computer communicates to a peripheral printer or other peripheral, as is understood in the art.

Also shown in FIG. 1 are a pair of retaining screws 20 secured within a pair of retaining portions 22 of connector body 14 and opposed to each other across the interface portion 18. The retaining screws 20 are aligned parallel to each other in an axial direction with reference to the axis 11 of the connector 10, as illustrated in FIG. 1. As is understood in the art, upon alignment and insertion of the typically rigid contact pins 16 into the aforementioned receptor, forming the requisite electronic interface, the connector 10 may then be physically secured to the aforementioned receiving device by engaging a corresponding pair of said retaining screws 20 to threaded holes within the receiving device, forming a threaded connection thereto, as is understood in the art.

As discussed, although the interconnection mechanism described above in connection with FIG. 1 suffices in the relatively passive confines of an office, the conventional retaining connector 10 configuration is unsuitable for a more active or mobile usage. Further, as known to all who have utilized the aforedescribed connectors 10, the securement process, i.e., aligning and threading the typically small retaining screws 20 axially (perpendicular to the opposed receiving surface), can be cumbersome and particularly difficult where axial or perpendicular access is limited.

A connector device 24 in accordance with the present invention ameliorates or overcomes the aforementioned disadvantages with an improved interconnection configuration, described in detail hereinafter. With reference now to FIG. 2, there is illustrated a presently preferred configuration of said connector device 24, which contains a connector body 26 attached along at least one end of said cable 12. Also shown are a multiplicity of contact pins 28 forming a pattern within an interface portion 30, as discussed. Instead of the aforedescribed axially-aligned retaining screws 20, however, shown in FIG. 2 (and subsequent figures) are a pair of transversely-aligned retaining or draw screws 32, which as will be discussed further herein interact with respective metallic hooks 34 that extend axially outward from said interface portion 30 for engaging a corresponding reception portion 50 of a receiving device 44 (shown in FIG. 5).

With further reference to FIG. 2, there are illustrated a pair of guide blocks 47 also extending axially outward from said interface portion 30. The connector 24 of the present invention preferably also differs from the connector 10 shown in FIG. 1 in that the contact pins 28 are spring-loaded and press against corresponding mating contact points 54 (shown in FIG. 5), typical in UDC applications. Whereas the rigid contact pins 16 actually insert into the receiving portion, the spring-loaded UDC-compatible contact pins 28 used in connection with connector 24 of the present invention engage their electrical contact points 54 by pressing against their surface rather than by pure axial insertion. The guide blocks 47 assist in orienting and aligning the contact pins 28 with the contact points 54, and positioning the connector assembly 24 accurately with the receiving device 44 prior to the full engagement of hooks 34 into a mating recess or receptor cavity 42 (also shown in FIG. 5).

Figure 4:
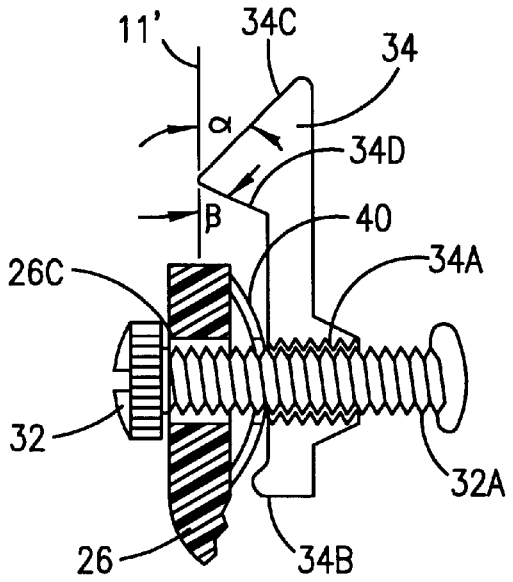
FIG. 4 is a further sectional view of a portion of the connector shown in FIG. 3.
Figure 3:
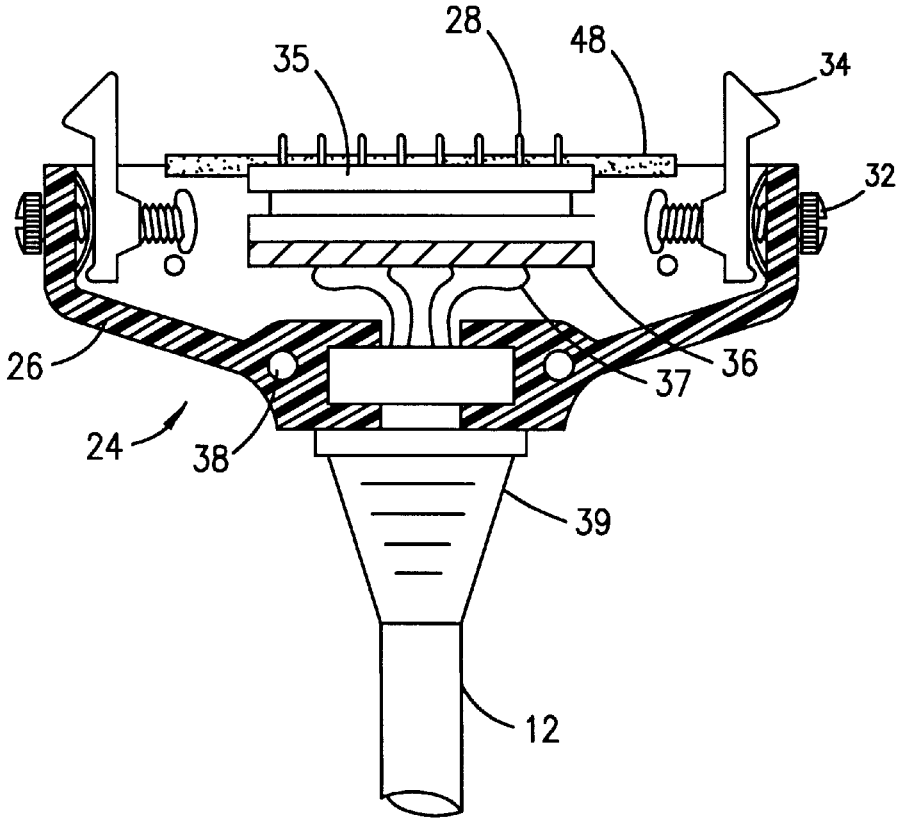
FIG. 3 is a side, sectional view of the connector shown in FIG. 2.

With reference now to FIGS. 3 and 4, there are shown side, cross-sectional views of the connector device 24 illustrated in FIG. 2. As shown in FIG. 4, the transversely-disposed draw screws 32 are threadedly engaged to the aforementioned respective hooks 34 through respective holes 34A along a bottom portion thereof, the top portion of said hooks 34 extending axially outward through respective slots 26A within the connector body 26, as shown in FIG. 2.

With particular reference now to FIG. 3, the connector device 24 also includes a contact block 35 secured to the sides of the connector body 26, preferably to a flat portion 26B thereof, as shown in FIG. 2. A printed wiring board 36 is secured to the contact block 35 and a multiplicity of wires 37, for carrying the various electronic signals through the cable 12 to said contact pins 28 via said printed wiring board 36, are also shown. A multiplicity of fastening screws 38 secure the cable 12 end to the connector body 26. As shown in FIG. 3, cable 12 may also include a strain relief portion 39 to provide additional support, as is understood in the art.

With particular reference now to FIG. 4, there is illustrated a portion of FIG. 3 in more detail. As shown in FIG. 4, the threaded shaft 32A of draw screw 32 extends through a clearance hole 26C through a side portion 26D of the connector body 26 and threadedly engages hole 34A through the lower portion of one of said hooks 34, as described hereinbefore. The draw screw 32 preferably terminates in a mushroom or cap portion 32B, which functions as a screw stop. It should be understood that the screw stop function may also be accomplished through use of a retaining ring 52 (shown and described in connection with FIG. 5) threaded around the screw shaft 32A, facilitating removal for servicing. It should further be understood that this screw stop functionality limits the retraction of the hooks 34, keeping them within the operating range of the mating recess geometry discussed further herein, as well as providing ease of alignment during assembly and preventing overtravel upon release.

In this first embodiment of the present invention, around the shaft 32A of draw screw 32 and between the connector body 26 portion around said hole 26C and the hook lower portion 34 around said threaded hole 34A is a return spring 40, where as the draw screw 32 is tightened, drawing the hook lower portion 34 closer to the connector body 26, the spring 40 is compressed, resisting the transverse movement of the draw screw 32, i.e., movement perpendicular to the aforedescribed axial line 11 shown in FIG. 2. It should be understood, however, that the bow of spring 40 is preferably large enough to move the hooks 34 clear of the aforementioned mating recess 42.

As discussed, as the draw screw 32 threads into the hole 34A of hook 34 and as spring 40 compresses, the hook 34 is drawn closer to the connector body 26. With further reference to FIG. 4, the lower portion of hook 34 may include a fulcrum portion 34B which is the first portion of the hook 34 to abut the connector body 26 as the draw screw 32 is turned. Accordingly, as the draw screw 32 continues to turn and the fulcrum portion 34B of hook 34 abuts connector body 26, the upper portion of the hook 34 cants about the fulcrum point, i.e., the contact point of fulcrum portion 34B and connector body 26, drawing the opposite upper portion of the hook 34 closer to the body 26. It should be understood that the diameter of the clearance hole 26C should be large enough to allow the hook 34 to so cant without the shaft 32A contacting the sides of the clearance hole 26C.

Figure 5:
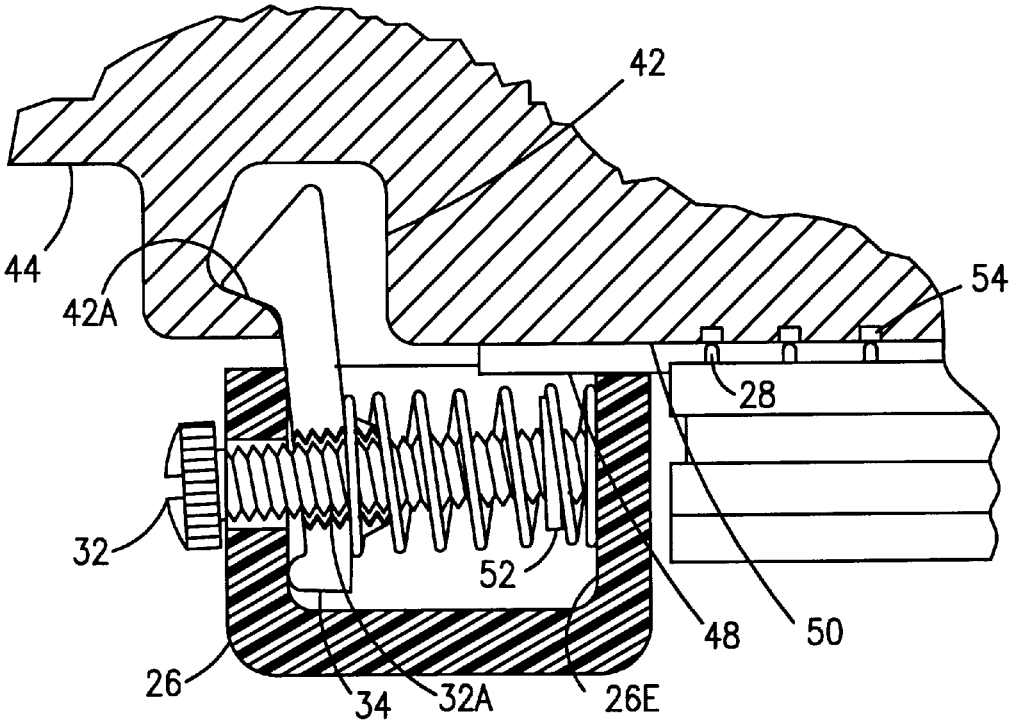
FIG. 5 is a side, sectional view of a portion of the connector shown in FIG. 3 in combination with a receiving device.

With reference again to FIG. 4 of the drawings, the upper portion of hook 34 preferably includes an angular nose or "hook" portion, particularly, a distal portion 34C and a proximal portion 34D thereof. In an initial, pre-tightening position, as shown in FIG. 4, where the hook 34 is vertically aligned (along line 11' parallel to line 11 in FIG. 2), the distal portion 34C of hook 34 is at a preferred angle of approximately 45 degrees, i.e., $\alpha$=45 degrees, which constitutes a lead-in angle for the hook 34 into the aforementioned receptor cavity 42 of the receiving device 44, a portion of which is shown in FIG. 5. It should be understood that as the distal, lead-in portion 34C enters the cavity 42, the tapered nature of the portions 34C of the opposed hooks 34 facilitates entry through the respective cavities 42 within the receiving device 44. Once the lead-in portion 34C is in, the proximal, "take-up" portion 34D engages an inner surface 42A of cavity 42 also shown in FIG. 5. When the aforementioned draw screw 32 is tightened, as shown in FIG. 5, the take-up portion 34D fully engages the inclined surface 42A, securing the respective part of the connector device 24 to the receiving device 44 via a frictional interference interconnection discussed further hereinafter. The preferred angle $\beta$ for the take-up portion 34D is also approximately 45 degrees.

It should be understood that in an alternative second embodiment of the invention, the hook 34 need not include the fulcrum portion 34B, eliminating the aforedescribed canting or overtravelling of the upper portion of hook 34 into the receptor cavity 42 as the draw screw 32 is tightened. It should in any event be understood that a strong mechanical, e.g., frictional interference, interconnection between the take-up portion 34D and inner surface 42A may nonetheless be attained by tightening the draw screw 32.

In another alternative embodiment of the present invention, the third, and presently most preferred embodiment, the above configuration of components is altered slightly to achieve another advantage. In the first and second embodiments, illustrated and described in connection with FIGS. 2–4, the spring 40 exerts an "inward" force on the hooks 34, pushing the hooks 34 towards each other. By placing the aforementioned springs more distally along the shaft 32A of the respective draw screws 32, i.e., on the opposite side of the hook 34, however, the hooks 34 may be spring-loaded and the connector device 24 could snap into place, retaining the angular or nose portion of the hook 34 within the cavity 42 while the draw screws 32 secure the device 24 in place.

Figure 6:
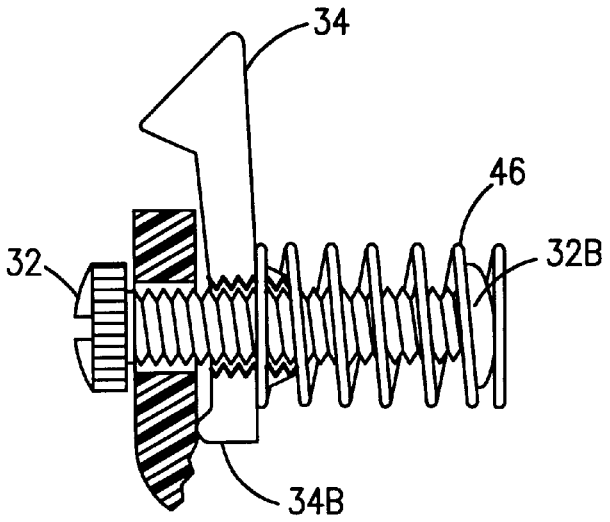
FIG. 6 is a side, sectional view of another embodiment of the present invention.

Shown in FIGS. 5 and 6 are examples of this alternate configuration, where a compression-type helical coil spring 46 is used rather than the flat-type return spring 40 shown in the preceding figures. Another advantage of this third embodiment is that release of the connector device 24 from the receiving device 44 is greatly simplified in that, upon sufficiently loosening the draw screws 32, the user may push (or squeeze) the draw screws 32 by hand against the spring 46 pressure, thereby releasing the two devices. It should, therefore, be understood that in this third embodiment, the aforementioned devices 24 and 44 may be engaged and used both with and without securing the draw screws 32, allowing versatility of use and facilitating threaded engagement of the draw screws 32 by the user. In other words, unlike the retaining screws 20 shown in FIG. 1, which typically require two hands and great manual dexterity in aligning the screws 20 within the respective holes, the snap-on feature and configuration of the third embodiment obviates the need for such precision.

With further reference to FIG. 5, the aforementioned retaining ring 52 is secured to the distal end of the draw screw shaft 32A, implementing the aforementioned functionality of screw stop. Also, the spring 46 bears against an internal surface 26E of the body 26, creating the aforedescribed snap-on feature.

It should also be understood that the subject matter set forth in the instant application may be applied in a variety of interconnection contexts, particularly, usages that are demanding and severe on equipment. One particular application for using the present invention is in the field of private radio systems, where increasing functionality and portability concerns are creating difficulties in equipment meeting specification requirements. For example, a hand set of a private radio system, such as within a police car, requires a mechanically secure connection to the radio. It should nonetheless be understood that the concepts set forth herein may be applied to related and diverse areas, e.g., a computer component connector, as well.

It should be understood that the connector body 26 is preferably composed of plastic materials and the strain relief portion 38 may be molded onto the cable 12. The hooks 34 are preferably metallic for rigidity and durability to withstand the stresses and strains of rugged use, and are preferably made of die cast aluminium or zinc. Cavity portion 42, particularly, the part surrounding inner surface 42A, should also be made of a resilient material so that the interconnection of the two devices is capable of surviving a measure of external forces acting against the interconnection.

It will also be understood that the connection device 24 may also include a gasket or seal 48, e.g., made of low durometer closed cell foam rubber or other flexible like material, around the pattern of contact pins 28, as shown in FIGS. 2, 3 and 5, which when the connection device 24 engages the receiving device 44, forms a hermetic seal to protect the electronic communications through the contact pins 28. In particular, as the hooks 34 engage, the recessed portion 30 with the gasket 48 thereon is drawn towards the receptor portion 50 of the receiving device 44, forming the aforementioned hermetic seal about the contact pins 28. It should therefore, be understood that an apparatus of the present invention employing such a seal 48 not only provides a secure mechanical attachment between two electronic components, isolating them from mechanical stresses and strains, but also provides a means to protect delicate electronic components from environmental damages such as rain and contaminants, further facilitating the use of devices employing the technology of the instant invention in a variety of conditions.

In a further embodiment of the present invention, further facilitating ease of use, is the use of a single draw screw 32/hook 34 combination, as compared to the opposing pair of screws 32/hooks 34 in the previous embodiments. The single draw screw 32/hook 34 combination is particularly useful in applications where spring-loaded contact pins 28 are used in place of rigid pins which insert into a mating socket. A connector device 24 employing only one such combination would require a rigid member at the opposite end of the connector 24, i.e., where the other screw 32/hook 34 would be. The rigid member may be configured similarly to the hook 34 to engage the cavity 42, as described, or may incorporate a more secure configuration, e.g., steeper angles $\alpha$ and $\beta$ to generate greater mechanical interference to compensate for the lack of tightening capability at that end.

It should be understood that an additional advantage of the hook configuration set forth in the present invention, as shown in FIGS. 2–6, over that of the conventional connector 10 shown in FIG. 1, is that there is no mating thread fastener (nut) incorporated into the receiving device, reducing production and standardization costs while providing quick access attachments for a variety of electronic equipment, such as radio systems.

It should finally be understood that although the most preferred angle for said lead-in ($\alpha$) and take-up ($\beta$) angles are about 45 degrees, a range of about 40 to 50 degrees is also preferred, as well as a wider range of about 30 to 60 degrees. The particular angles for $\alpha$ and $\beta$ may be selected for usage in a particular configuration, e.g., $\beta$ may be adjusted to optimize frictional interference of the take-up portion 34D with the inner surface 42A when the hook 42 overtravels within the receptor cavity 42, as described in connection with the first embodiment, or when the two surfaces 34D and 42A engage as they are drawn together in the second, third and fourth embodiments. Furthermore, "take-up" angle $\beta$ may range up to 90 degrees if the take-up feature is not utilized. It should be understood, however, that although in this instance more positive interference is realized, little or no compression of the contact pins 28 or gasket 48 is accomplished by transverse tightening of the draw screws 32.

The previous description is of presently preferred embodiments for implementing the invention, and the scope of the invention should not necessarily be limited by this description. The scope of the present invention is instead defined by the following claims.

What is claimed is:

1. In combination between a first and a second device, a connection apparatus for securing said first and said second devices together, said connection apparatus comprising:

engaging means, within said first device, for axially engaging a receiving means within said second device;

a screw extending transversely within said first device and threadedly engaging said engaging means, whereby as said screw threadedly engages said engaging means, said engaging means secures said first and second devices together; and spring means positioned along said screw between a head portion of said screw and said engaging means.

2. The connection apparatus of claim 1, wherein said spring means comprises a return spring.

3. In combination between a first and a second device, a connection apparatus for securing said first and said second devices together, said connection apparatus comprising:

engaging means, within said first device, for axially engaging a receiving means within said second device;

a screw extending transversely within said first device and threadedly engaging said engaging means, whereby as said screw threadedly engages said engaging means, said engaging means secures said first and second devices together; and spring means positioned along said screw distal of said engaging means.

4. The connection apparatus of claim 3, wherein said spring means comprises a helical coil.

5. A connection device for securing a first device to a second device, said connection device comprising:

a pair of opposed hooks, each of said hooks having a lower portion and a hooked upper portion;

a pair of opposed fasteners, each of said fasteners secured to said first device and to the lower portion of a respective one of said pair of hooks, said upper portions of said hooks extending axially outward from said first device and engaging said second device, said fasteners extending transversely within said first device; and spring means positioned along at least one of said pair of opposed fasteners between a head portion of at least one of said fasteners and a respective one of said hooks, whereby said fasteners upon fastening secure said first device to said second device.

6. The connection apparatus of claim 5, wherein said spring means comprises a return spring.

7. A connection device for securing a first device to a second device, said connection device comprising:

a pair of opposed hooks, each of said hooks having a lower portion and a hooked upper portion;

a pair of opposed fasteners, each of said fasteners secured to said first device and to the lower portion of a respective one of said pair of hooks, said upper portions of said hooks extending axially outward from said first device and engaging said second device, said fasteners extending transversely within said first device; and spring means positioned along at least one of said pair of opposed fasteners distal of a respective one of said hooks, whereby said fasteners upon fastening secure said first device to said second device.

8. The connection apparatus of claim 7, wherein said spring means comprises a helical coil.

* * * * *